US006535712B2

(12) United States Patent
Richards

(10) Patent No.: US 6,535,712 B2
(45) Date of Patent: Mar. 18, 2003

(54) GLOSS CONTROL METHOD AND APPARATUS WITH DISPOSABLE TONER CARTRIDGES CONTAINING CLEAR TONERS

(75) Inventor: Mark P. Richards, Boise, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/900,723

(22) Filed: Jul. 6, 2001

(65) Prior Publication Data

US 2003/0007814 A1 Jan. 9, 2003

(51) Int. Cl.[7] ..... G03G 15/20
(52) U.S. Cl. ..... 399/341
(58) Field of Search ..... 399/341, 53, 54, 399/107, 111, 226, 262; 430/42, 45, 97, 110; 347/1, 19, 98, 171, 172

(56) References Cited

U.S. PATENT DOCUMENTS

| | | | | |
|---|---|---|---|---|
| 5,260,753 A | | 11/1993 | Haneda et al. | 399/54 |
| 5,339,148 A | | 8/1994 | Johnson et al. | 399/341 |
| 5,506,671 A | | 4/1996 | Buts et al. | 399/39 |
| 5,594,535 A | | 1/1997 | Beaufort et al. | 399/262 |
| 5,612,777 A | | 3/1997 | Malhotra | 399/226 |
| 5,751,432 A | * | 5/1998 | Gwaltney | 399/341 X |
| 5,799,230 A | | 8/1998 | Lloyd | 399/107 |
| 6,006,668 A | | 12/1999 | Rehmann | 101/484 |
| 6,397,030 B1 | * | 5/2002 | Watanabe | 399/237 |

FOREIGN PATENT DOCUMENTS

| | | |
|---|---|---|
| EP | 0 081 887 B1 | 4/1985 |
| EP | 0 324 192 B1 | 3/1993 |
| JP | 01021732 | 8/1990 |

* cited by examiner

*Primary Examiner*—Hoan Tran

(57) ABSTRACT

A system for controlling the gloss or matt finish on printed media where a clear toner disposable cartridge system is used to apply a clear toner to the surface of a printed media.

15 Claims, 13 Drawing Sheets

GLOSS CONTROL METHOD AND APPARATUS WITH DISPOSABLE TONER CARTRIDGES CONTAINING CLEAR TONERS

RELATED APPLICATIONS (Not applicable)

STATEMENT REGARDING FEDERALLY SPONSORED RESEARCH OR DEVELOPMENT (Not applicable)

FIELD OF THE INVENTION

This invention relates to toner application systems and toner cartridges for imaging, such as inkjet and electrophotographic imaging.

BACKGROUND OF THE INVENTION

In the practice of conventional electrophotographic imaging, it is the general procedure to form electrostatic latent images on a surface by first uniformly charging a charge retentive surface such as a photoreceptor or charge retentive imaging surface. The charged area is selectively dissipated in accordance with a pattern of activating radiation corresponding to original images. The selective dissipation of the charge leaves a latent charge pattern on the imaging surface corresponding to the areas not exposed by radiation.

This charge pattern is made visible by developing it with toner by passing the photoreceptor past one or more developer housings. In monochromatic imaging, there is usually a single housing with toner comprising black thermoplastic powder particles which adhere to the charge pattern by electrostatic attraction. For color imaging, there are three developer housings each with a toner of a different subtractive color, cyan, magenta, yellow, and optionally black in a forth fourth developer housing. Latent images are developed with each of the developers, forming a color toner image for each color on the imaging surface. The developed image is then transferred to a receiving substrate or print media, such as plain paper, to which it is fixed by suitable fusing techniques.

Ink-jet printing is a non-impact printing process in which droplets of ink are deposited on print media, such as paper, transparency film, or textiles. Essentially, ink-jet printing involves the ejection of fine droplets of ink onto print media in response to electrical signals generated by a microprocessor.

There are two basic means currently available for achieving ink droplet ejection in ink-jet printing: thermally and piezoelectrically. In thermal ink-jet printing, the energy for drop ejection is generated by electrically-heated resistor elements, which heat up rapidly in response to electrical signals from a microprocessor to create a vapor bubble, resulting in the expulsion of ink through nozzles associated with the resistor elements. In piezoelectric ink-jet printing, the ink droplets are ejected due to the vibrations of piezoelectric crystals, again, in response to electrical signals generated by the microprocessor. The ejection of ink droplets in a particular order forms alphanumeric characters, area fills, and other patterns on the print medium.

Recently, there has been a great deal of effort directed to the development of color copiers, and printers, which utilize the electrophotographic and/or ink jet imaging process.

Notwithstanding all the recent development in the area of monochromatic and color printers and copiers, there is room for improvement in the quality of images and the convenience in their operating and maintenance. In particular, there is yet a great need in the reproduction of high quality graphic images in systems that are inexpensive and are low-volume, such as conventional printer and copier systems used in business offices and at home. Currently, there is a level of print quality that can be achieved only in expensive, high-volume, commercial printing systems. To achieve or even approach this same quality in a low-volume, inexpensive system would be an advance not yet achieved in the art.

High quality graphics are often required for advertising, and promotional materials. Examples include brochures, programs, posters, and the like, and are often characterized by high-resolution color images with a quality finish, such as a clear high gloss finish. In commercial printing shops, these are usually created by first using an offset, or the like, printing systems to print a high-resolution image on a media, and then applying a clear coat of a varnish, or aqueous material to create a clear shiny gloss finish. This system works well for large printing orders, but is impractical for use for a small volume, because of the setup time and the cost of the equipment. For only a few copies, the investment in equipment and set-up time, makes the per copy cost prohibitive.

Another requirement in obtaining a desired gloss level, has been to choose an appropriate media, and configuring the printing device to apply an appropriate coating, based upon the print media. One way in which a printing device can be so configured to a particular to print media is to have a user make manual adjustments to the printing device based upon these characteristics. One problem with this approach is that it requires user intervention, which is undesirable. Another problem with this approach is that it requires a user to correctly identify and differentiate between glossy-finish and matte-finish print media which some users may be unable to do. A further problem with this approach is that a user may incorrectly manually configure the printing device so that optimal printing still does not occur in spite of user intervention. In environments where user training is low, and there is little ability or desire to stock and administer different print media, the manual approach has been unsuitable.

Printing devices, such as electrophotographic and inkjet printers and copiers, use printing composition (e.g., ink or toner) to print text, graphics, images, etc. onto print media. The print media may be of any of a variety of different types. For example, the print media may include letter quality paper, transparencies, envelopes, photographic print stock, cloth, etc. These print media may be placed in one of two broad categories relating to the finish of the surface of the print medium. These categories are glossy-finish for things such as transparencies and photographic print stock and matte-finish for things such as letter quality paper and envelopes. A glossy-finish is a print media finish that provides a surface brightness or shine when illuminated by a light source. A matte-finish is a print media finish that lacks surface brightness or shine when illuminated by a light source. Glossy-finish and matte-finish print media each have various characteristics that often effect the quality of the image and ideally should be accounted for during printing. Otherwise a less than optimal printed output may occur. For example, in electrophotographic printing, a high-gloss media often induces stray charges and the scattering of toner on the surface. This problem can be largely solved using matt media, but this precludes the user from obtaining high-quality reproductions with a high-gloss surface.

The color copier and printer technologies used in small volume and personal systems can now create high-resolution color images of a resolution approaching that achievable in commercial printing systems. However, although the image is of better quality, these systems, for the most part, are unable to create surface finish that can be obtained from large commercial printing equipment. The equipment for applying the finish, which usually involves coating varnish or aqueous substances on the media, is too large and expensive for office copier and printer applications. In addition, to optimize the finish the equipment requires careful setup of the equipment and the media or substrate must be chosen carefully to achieve optimum results. This is not suitable in many business offices where the user wishes only a few copies and has little or no training in the operation of printing equipment.

The ideal system for such users would be a consumer-level low-volume system that has a higher capability to produce commercial quality printing, which includes high quality color images with a finish of predetermined gloss. The system would be adaptable to small volumes and require little training, such that it can be used in the same way that small printers and copiers are currently used. The additional equipment for applying the gloss should not require special and additional setup time, and it should be serviceable in a manner familiar to the user, much like existing copier/printer equipment. In addition, the system should create a consistent gloss finish that is largely independent of the finish of media used, so that the user does not have to use special paper/media types to achieve the desired results, but can use a single "standard" media and still achieve any desired gloss or matt finish. In addition, the system should be capable of forming the gloss finish, without undue manual intervention and adjustment by the user.

In the prior-art, transparent or clear toner compositions have been applied to surfaces, using processes similar to those for applying chromic toners. Some of these processes have involved the use of an additional developer housing that contains a clear polymeric toner material. These clear toner compositions are designed to impart certain properties to the final image, such as improved adherence of the image, abrasion resistance, optical stability, whiteness, or level off the relief pattern presented by superimposed toner and image layers. The problem with many of these systems is that they are complex, and integrated into specialized imaging systems and are not easily designed applied to small volume, inexpensive, systems.

A devise that can provide gloss control of printed images, that is inexpensive to use, can be applied easily in existing and future imaging systems of various types, requires little or no additional user training and intervention to provide quality copies, and can be applied to inexpensive and low-volume imaging systems, would fill a long felt need in the art.

Incorporation by Reference

U.S. Pat. No. 5,799,230, "Compact Electrophotographic Color Developer Module" issued Aug. 25, 1998 to Lloyd; and U.S. Pat. No. 5,594,535, "Refillable Toner Cartridge" issued Jan. 14, 1997, to Beaufort et al.; U.S. Pat. No. 5,506,617, "Electrostatographic Printing Including the Use of Colourless Toner" issued Apr. 9, 1996 to Buts et al.; U.S. Pat. No. 5,978,642, "Color Printer With Shuttle Type Paper Drive and Method, issued Nov. 2, 1999 to Arcaro et al.; and U.S. Pat. No. 6,006,668, "Glossy or Matte-finish Media Detector and Method for Use in a Printing Device," issued Dec. 28, 1999 to Rehmann are hereby incorporated herein by reference.

BRIEF SUMMARY OF THE INVENTION

The present invention involves system for use in printers and copies and can be used to form a consistent gloss-level or finish on a printed media. In summary, the invention comprise a toner cartridge system for applying clear, colorless or transparent toner to the surface of an imaged product, i.e., a media with at least one fixed or unfixed toner layer, either one monochrome layer or several color layers. The media is usually paper, but includes any opaque or transparent media used in imaging. The clear toner is contained in a disposable toner cartridge. The disposable cartridge is similar to prior-art chromic cartridges and can, therefore, be installed and used in the same manner as the prior-art cartridges. Usually such cartridges comprise a toner hopper, seal assembly, photoconductive drum assembly and corona assembly.

An aspect of the invention is an imaging apparatus comprising at least one toner application unit or developer station for applying color toner images to a media. The apparatus is preferably electrophotographic, and may be monochrome or have multiple colors. The apparatus further comprises at least one disposable toner cartridge. The disposable toner cartridge is removably and nonfixedly attached to the imaging apparatus. That is it is attached such that it can be removed by hand without destroying any of the structure used for the attaching, or without the use of tools. The removable and nonfixed attachment allows the toner cartridge to be easily and quickly removed and replaced with another toner cartridge. This may be required if a toner composition with a different surface finish is required, or if a cartridge become depleted and requires quick replacement with a full cartridge. The structure for removable attachment may be any suitable structure known in the art. For example, mounting structure on the cartridge, such as curved or angular mating surfaces in the cartridge housing, sliding surfaces, grooves, knobs, locks, apertures, sprung members, and the like, that may interact or interlock or mate, with opposing or mating structures associated on the imaging apparatus.

The cartridge elements are constructed together as a removable housing or unit so that all can be removed together and disposed of. The cartridge comprises the housing containing a clear toner hopper for holding clear toner and an outlet from which the clear toner can flow. When the clear toner has been depleted, the clear toner cartridge can be removed and discarded, or recycled by any suitable means, such as by remanufacturing or by refilling the cartridge with new clear toner.

The cartridge also contains other components required to apply the clear toner on the media surface, which for a electrophotographic application comprises a photoconductive drum with a charge retentive surface disposed to receive clear toner from the outlet in order to form a layer on the charge retentive surface when it is charged. There is also a corona assembly for charging the charge retentive surface so that the clear toner can be applied. If required, a drive structure is included to assist in transport of media across the toner application unit, which for electrophotographic system may include magnet rollers. In an aspect of the invention, no image is formed upon the photoconductive drum and a continuous coating is formed on the photoconductive drum for transfer to the media. However, a suitable imaging array may be included to image the photoconductive drum and selectively apply toner in a pattern or in spots.

The removable cartridge may optionally comprise a seal assembly that provides a seal against flow of toner through the outlet. This seal is to prevent to spillage of clear toner before the cartridge is attached to the imaging apparatus. The seal assembly prevents toner leakage by preventing toner from leaving the hopper. When the cartridge is first used, the seal is removed, usually by removal of a sealing member to allow the toner to flow out of the toner hopper opening for application on the media surface.

As part of the imaging apparatus there may be structure, if required, for transferring clear toner from the disposable cartridge unit to the media surface. For electrophotographic systems, there may be a structure (e.g., intermediate transfer belts or rollers) for transferring toner on the charge retentive surface of the cartridge to the media surface and over the color toner image on the media surface. The color and clear toners are fused to the media surface by suitable fusing stations, for example, heated rollers. The color toners and clear toners may be fused together or separately.

The disposable clear-toner cartridge system of the present invention can be designed separately from the main imaging system, and accordingly does not require extensive redesign of the imaging system to incorporate the invention. An imaging system incorporating the invention might involve an apparatus comprising one or more developer stations for forming color images on a charge retentive surface, a disposable clear-toner cartridge of the invention, and one or more fusion stations to fuse the color images and the clear toner. In one aspect of the invention, the invention may be easily applied to the output of any imaging system. By providing clear toner fixing systems separate from the fixing systems of the color imaging system and a separate transport system coordinated with the output of the imaging system, an apparatus of the invention can treat the product of the imaging system with the clear toner layer with minimal modification of the basic imaging system. Basically, the invention can be applied in a stand-alone apparatus designed to be hand fed or fed by a variety of imaging systems to which the invention is attached to provide a controllable and predictable gloss on the finished product from these systems. The invention may also be incorporated integrally into an imaging system, or as an add-on accessory to an imaging system. Because of the wide applicability of the present invention, a single clear toner application system may be designed to be interchangeably used in an entire line of imaging (copying and printing) systems, which may extend over thermal- and piezoelectric-inkjet systems, thermal systems, impact systems, and electrophotographic systems.

The clear-toner cartridge of the invention may be placed before or after the fusing or fixing of the color toner images on the media. If placed after the fusion station for the color toner images, an additional toner fusing station can be used to fuse the clear toner onto the media and the underlying already fused color toners. In addition, more than one disposable clear toner cartridge of the invention may be used if it is desired to add an additional clear toner to the product. Each may have its own fusion station or there may be a common fusion station for clear-toner cartridges, which may or may not also be a fusing station for color toners.

The clear toner cartridge of the invention may also be associated with a control system that selectively applies a clear toner to the product, based upon whether measured gloss property of the product meets a preset condition. For example, if it is desired to produce a product with a predetermined and consistent gloss, independent of the gloss of the paper media or substrate, a clear toner with a gloss enhancer can be applied if the media has a matte finish, and not applied if a gloss finish. Likewise, matting agents may be selectively applied to achieve a predetermined matt finish. Multiple layers of clear toner may be applied to account for variations in the media, to permit, for example, additional layers of gloss enhancer or matting agents to increase their effect. Multiple layers may be applied using a system with multiple disposable clear-toner cartridges, or the transport system associated with cartridge may have a shuttle or recycling system, as illustrated below. In a system with multiple clear-toner cartridges, the control system may selectively apply two different clear-toner compositions based upon a product property. For example, clear toner with a matting agent from one cartridge, or clear toner with a gloss enhancer from a second cartridge may be selectively applied, based upon the measured gloss of the product. The gloss property can be based upon any property that is a qualitative measures the reflectance of any or all of the visible wavelengths, as long as such measures are a qualitative measure of the perceived gloss, shine, matt, dullness, or color tint of the surface.

The method of measuring the gloss property may be may any suitable method. The gloss of a fixed toner image can be measured by any of known techniques. These include measurement of a reflectance value R determined at measuring angle, usually 60 degrees, such as in DIN standard No. 67 530 (November 1972). Reflectance measures indicating a tint can be measured for any visible wavelength, by using, for example, suitably colored filters, prisms, gratings or other systems of segregating the wavelength. Suitable media gloss detectors are disclosed in U.S. Pat. No. 6,006,668.

An aspect of the present invention is a printing system with a print station comprising one or more color toner application units for applying a color image on a media, and after the print station a clear toner disposable cartridge for applying clear toner on the media over the color toner image. The color toner application units and the clear toner cartridge may be electrophotographic or inkjet systems. The inkjet units may be piezoelectric or thermal systems.

The print zone may comprise only one color toner application unit, usually with black toner, or multiple color toner application units. Usually multicolor systems have three or four color toner application units, with cyan, magenta, yellow, and optionally black toner. Whether inkjet or electrophotographic, multiple color toner application units may be disposed relative to the media to apply their toners to the media surface in one pass, or a separate pass for each color.

The clear and color toners of the invention may be solid or liquid. The toners may be fixed to the media by any suitable fixing system appropriate to the toner used. Suitable fixers include, but are not limited to, heated rollers, solvent evaporators, electromagnetic wave (e.g. UV light, microwave, etc.) curing stations, heated air streams, and the like.

The clear toners in the present invention are essentially the same composition as color toners used in the art, except for the dyes and pigments. The clear toners are substantially transparent, such that the inherent colors of the applied color toners are not materially masked and the relative amount of reflected light from the image is essentially maintained and not materially diminished by the clear toner. The clear toner may be slightly tinted, pigmented or dyed up to a degree where it is substantially transparent uniformly over the visible spectrum (400 to 700 nm). Tinted toners maybe desired where a product with a special effect is desired, such an antiqued or aged appearance using, for example, a sepia-toned, gray or yellow tinted clear toner. Other suitable tints, such as pink, green, blue, or other tints may be used if desired. A tinted gloss property can be qualitatively determined, for example, by measuring reflectance of the surface at different wavelengths.

The colored toners are those used in the art and include any toner reflecting or absorbing red, green and blue light in equal or different degree to produce a visually detectable white, black or "monochrome" image. So, a "color" toner in the scope of the present invention may contain one or more of white, black, or color matter or colorants, which absorb (subtract) light from certain parts of the visible spectrum. These include yellow, magenta, and cyan toners.

The clear toner of the invention may include additives, as long as such additives do not materially compromise the clarity of the toner and finish of the fixed toner on the media. Suitable additives, include, for example, UV adsorbance agents, abrasion resistance agents, optical brightening agents, gloss improvement agents, surface modification agents, and the like. To control the finish, the toner may include any suitable gloss or matting agents. Matting agents may include white pigments, such as colloidal $TiO_2$ particles of a concentration in the toner that maintains the translucent character of the clear toner.

The clear toner composition is selected from any suitable composition known in the art. For electrographic toners, this includes, but is not limited to, a binder in the form of a clear resin. Such toners included, but are not limited to, (A) polyesters; (B) polyvinyl acetals; (C) vinyl alcohol-vinyl acetal copolymers; (D) polycarbonates; and (E) styrene-alkyl alkyl acrylate copolymers and styrene-aryl alkyl acrylate copolymers; (F) styrene-diene copolymers;(G) styrene-maleic anhydride copolymers; (H) styrene-allyl alcohol copolymers; and mixtures thereof. The toner may also include any suitable additive known in the art. These include (1) charge control additives such as alkyl pyridinium halides, cetyl pyridinium chloride, cetyl pyridinium tetrafluoroborates, quaternary ammonium sulfate and sulfonate compounds, such as distearyl dimethyl ammonium methyl sulfate; (2) surface additives such as straight silica, colloidal silica, Unilin, polyethylene waxes, polypropylene waxes, aluminum oxide, stearic acid, polyvinylidene fluoride, and the like; (3) surfactants such as nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octyphenyl ether, polyoxyethylene oleyl ether, polyoxyethylene sorbitan monolaurate, polyoxyethylene stearyl ether, polyoxyethylene nonylphenyl ether, and the like.; and (4) light fastness inducing agents such as 1,2-hydroxy-4-(octyloxy) benzophenone, 2-(4-benzoyl-3-hydroxyphenoxy) ethylacrylate and the like.

Suitable inkjet clear toners include any of the "ink" compositions used in inkjet printing, but without the colorant, dye, or pigment. Typically, these compositions comprise an aqueous vehicle containing one or more water-miscible organic solvents. Additionally, these inks may further comprise additives to improve a given property, such as waterfastness, color bleed, and the like. The compositions may optionally comprise any one of surfactants, buffers, biocides, and metal chelators. The inks may further include water miscible polymers. The clear inkjet toner composition may also contain ingredients to control the viscosity of the composition.

DETAILED DESCRIPTION OF THE INVENTION

Figure 1A:
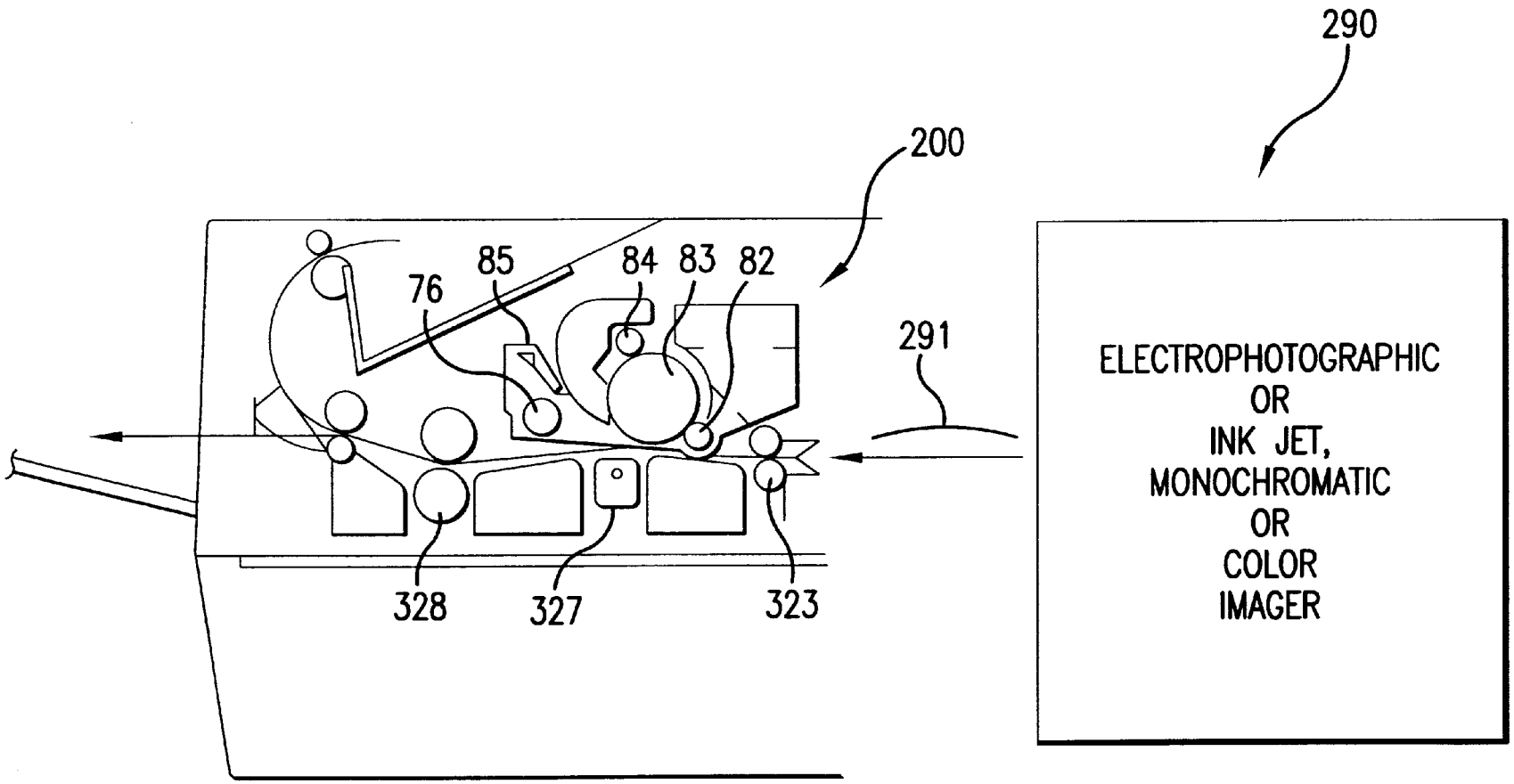
FIG. 1*a* is a simplified schematic of a generalized imaging system incorporating a disposable clear toner cartridge of the invention.

Reference is now made to FIG. 1*a,* which is a generalized schematic of a clear toner cartridge of the invention incorporated into an imaging system. It should be noted that the present invention is not limited to a specific embodiment illustrated in this or other Figures, and other systems within the spirit of the invention are contemplated. The imaging system 290 produces a printed product or sheet 291 that is a media with a fixed or unfixed color image thereon. The imaging system may be electrophotographic, ink jet, or any other suitable system. Product 291 is fed through a pair of rollers 323 to convey the sheet fed from the imaging system 290.

A transfer electrostatic charger 327 is used for transferring toner from the photosensitive drum 83 to the printing sheet. A pair of heat rollers 328 is used for fixing the clear toner transferred on the printing sheet. Disposable clear toner cartridge 200 of the invention is used to apply clear toner.

The clear toner disposable cartridge 200 has an electrostatic charger 84 for electrostatic charging the photosensitive drum 83 uniformly. The cartridge may also optionally comprise a cleaner 76 for eliminating the untransformed or waste toner on the photosensitive drum 83 as well as the developing roller.

Figure 1B:
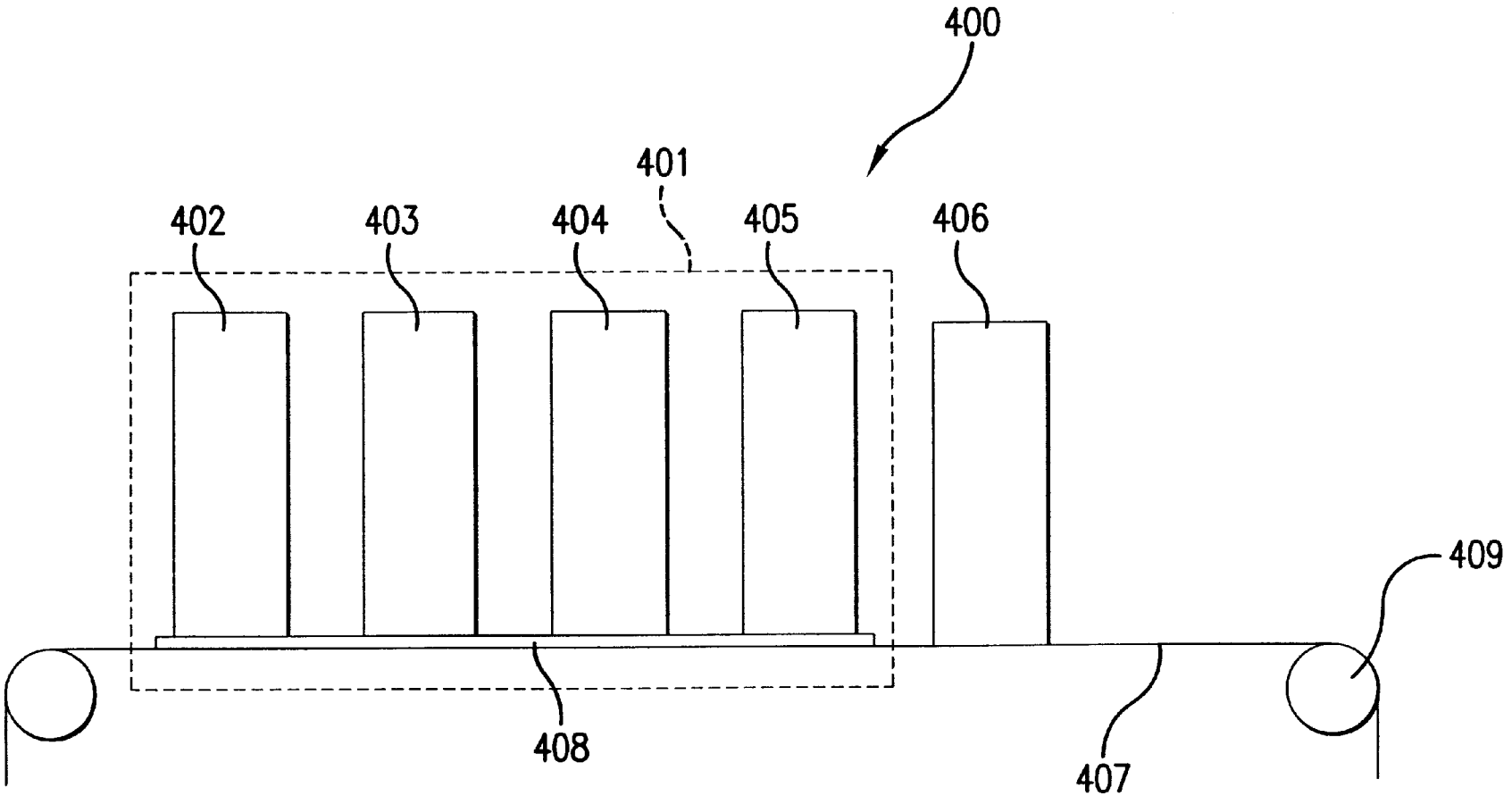
FIG. 1*b* is a simplified schematic of another generalized imaging system of the invention.

Reference is now made to FIG. 1*b,* which schematically shows a printing system according to the invention. A toner system 400 comprises a print station 401 with one more color toner application units 402, 403, 404, 405. Media 408 is passed by the color toner application units along media path 408 by appropriate media transport structure 409. Optionally, the toner application units may be moved or passed across a stationary media by appropriate apparatus, either separately or together. The color toner application units may be present in any number, but are usually one for a monochrome printer, and three or four for a multicolor printer. Instead of multiple application units, a single multichambered color application unit may be used instead. For monochrome systems, the toner is usually black, and for multi-color, the toners are usually cyan, magenta, yellow, or these same three with black. The color application units may be electrophotographic, or inkjet (piezoelectric or thermal), and color toners may be liquid or solid.

A clear application unit 406 applies a clear toner upon the media over the color image applied by the color application units. The clear application unit 406 may the same type as or a different type from the color application units, and may also be electrophotographic, or inkjet (piezoelectric or thermal), and the clear toner may be liquid or solid.

Figure 2A:
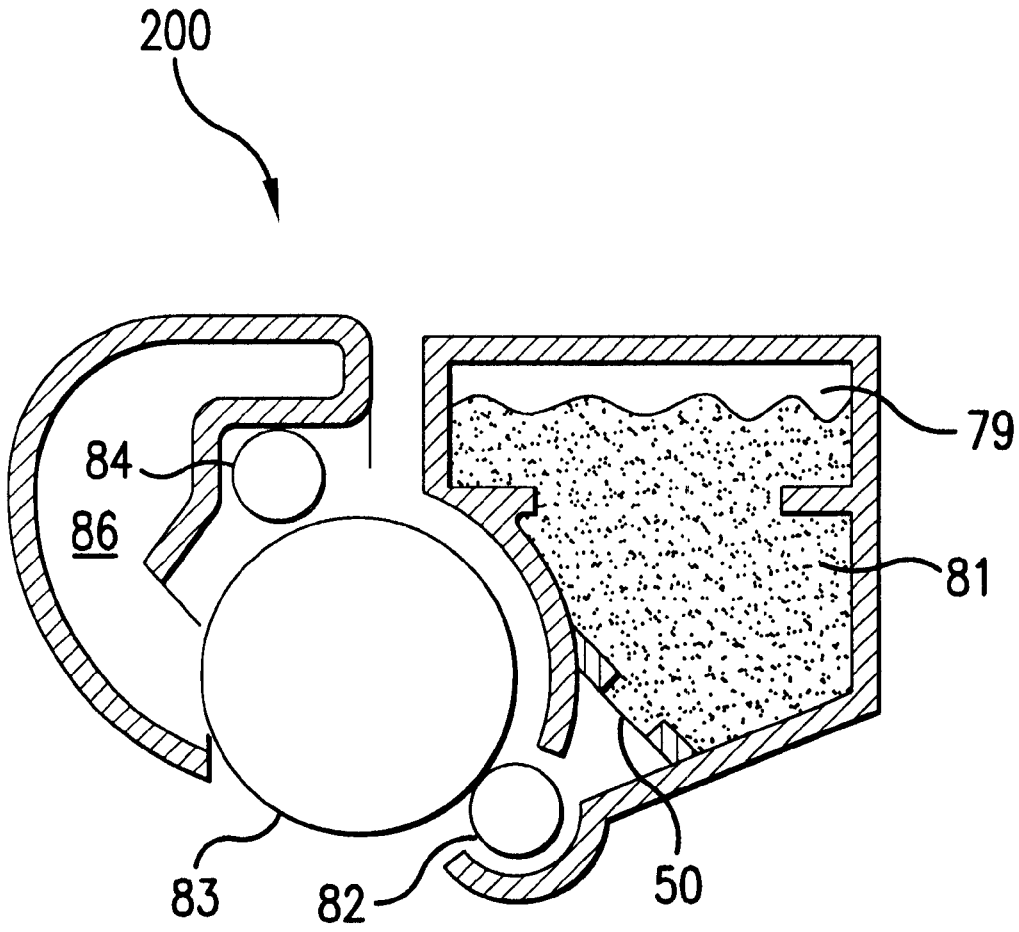
FIG. 2*a* is a simplified cross-section of the disposable clear toner cartridge in FIGS. 1*a,* and 3 to 6.

Reference is now made to FIG. 2*a,* where a simplified cross sectional view of disposable clear toner cartridge 200 is shown. Corona assembly in the form of a charging roller 84 provides the uniform electrostatic charge on the photosensitive drum 83. Clear toner 81 is applied to photosensitive drum 83 through developer roller 82. After the electrostatic latent image is transferred from photosensitive drum 83, any waste toner is removed and stored in waste hopper 86. Clear toner 81 is contained in toner hopper 79.

Figure 2B:
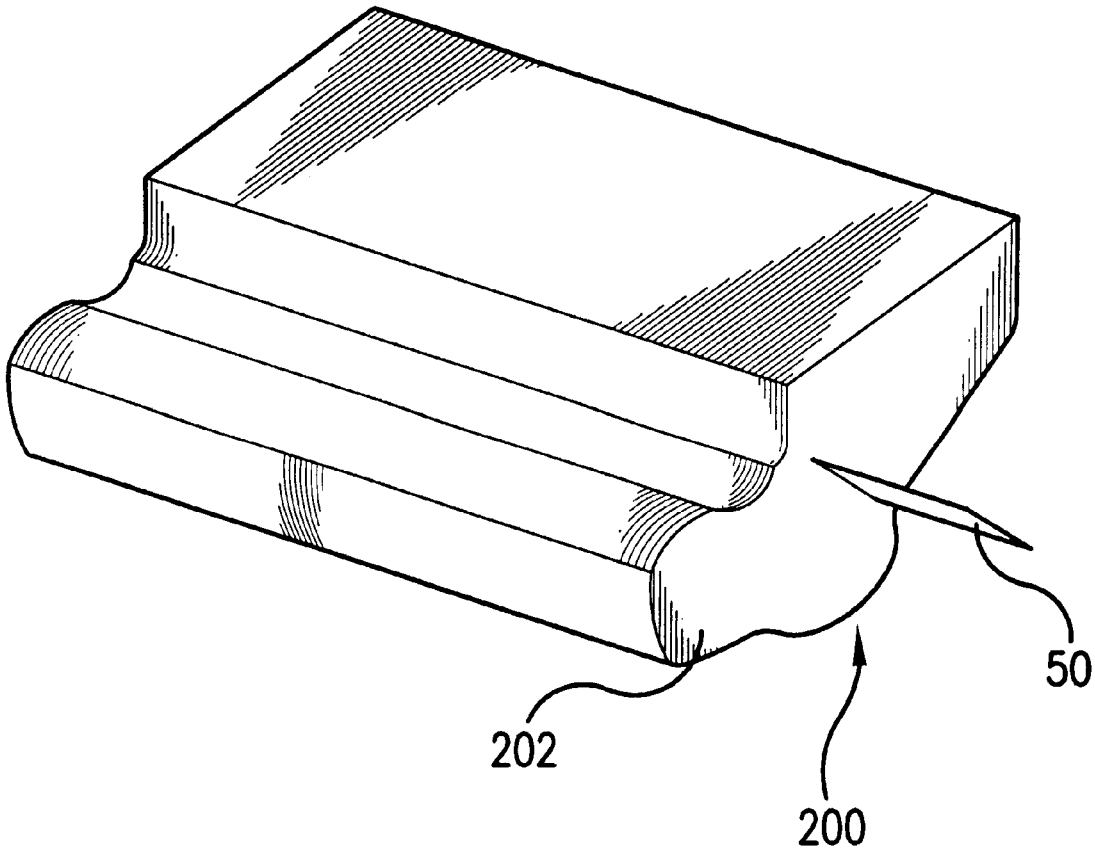
FIG. 2*b* is a perspective view of the cartridge of FIG. 2*a*.

Reference is now made to FIG. 2*b,* which is perspective view of the toner cartridge of FIG. 2*a.* The toner cartridge comprises structure for mounting the cartridge in the imaging apparatus, which in the illustrated version comprises a shaped housing 202 to mate with and match structure in the imaging apparatus. Also shown in FIG. 2*a* and FIG. 2*b* is cartridge seal 50. Cartridge seal 50 seals toner 81 during transportation of toner cartridge 200. Prior to inserting toner cartridge 200 into the printing apparatus 300, cartridge seal 50 is removed. However, once cartridge seal 50 has been removed, toner 81 is allowed passage towards developer 82. It can be appreciated other disposable cartridge designs are contemplated by the invention. Any suitable disposable cartridge system for applying clear toner to a substrate within the spirit of the invention is contemplated. Such systems include, but are not limited to, those that incorporate photosensitive belt and carousel toner transfer system. Other suitable systems are disclosed in U.S. Pat. No. 5,594,535.

Figure 3:
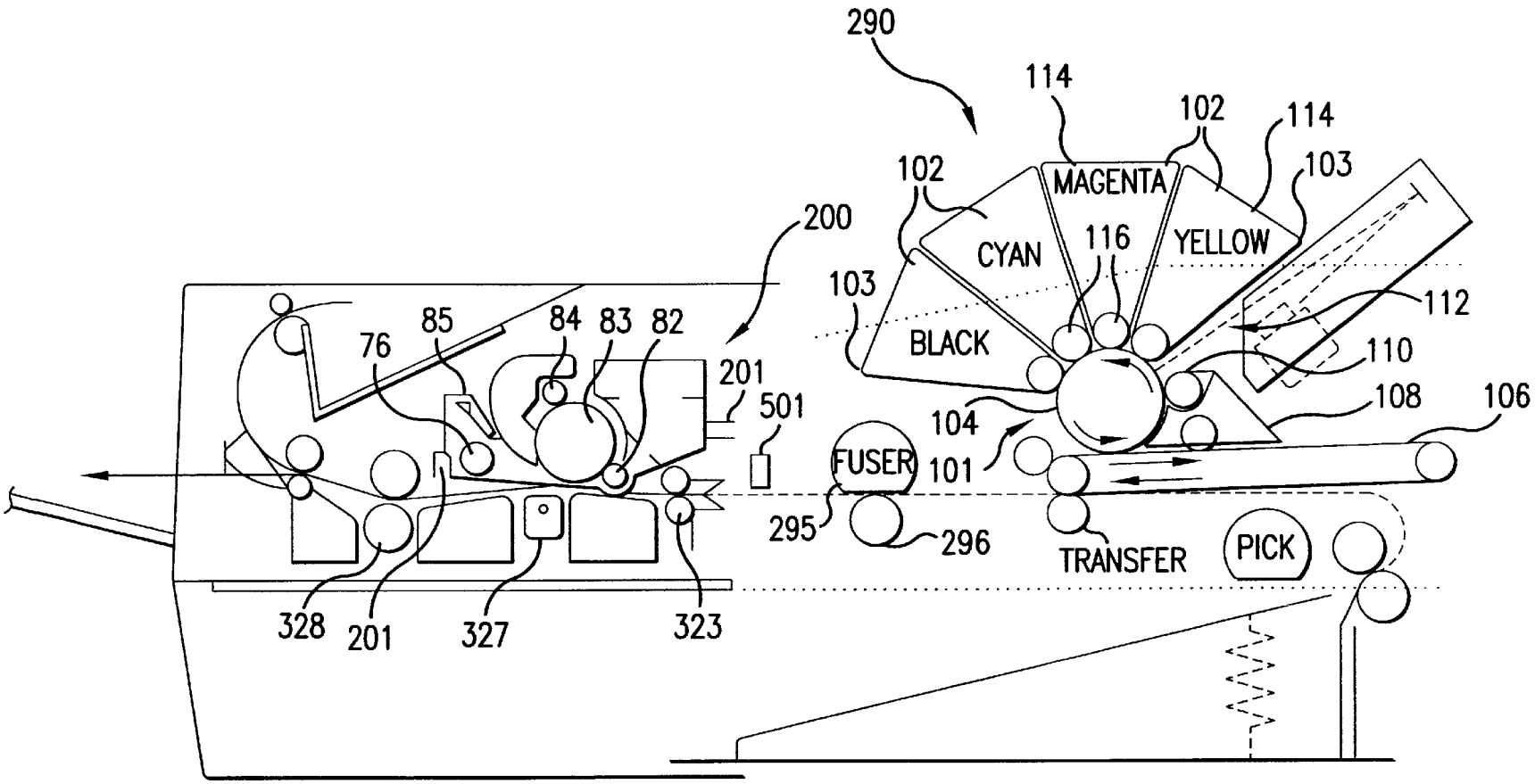
FIG. 3 is a simplified schematic of an electrophotographic color imaging system incorporating a disposable clear toner cartridge of the invention.

Reference is now made to FIG. 3, which is a schematic of an imaging system as in FIG. 1*a,* showing an electrophotographic imaging system for applying color toners. This system for applying color toners is not intending to be limiting and it is contemplated that other color imaging systems can be used in the invention, such as those disclosed in U.S. Pat. No. 5,799,230. In this version, a wide-V configuration color module 101 is shown. The module 101 includes a canister which is disposed at an angle <45.degrees relative to horizontal and which has a front outer extremity 103 at approximately 20.degrees relative to the horizontal plane of the OPC drum axis. Included are radially disposed, wedge-shaped developers 102, a small OPC drum 104, an IT belt 106, waste toner station 108, charging station 110, and laser exposure station 112. The developers are designed to take up a minimum of space, to be individually interchangeable, and to be compatible with a small OPC drum. The wedge shape of the developer canisters 114 allows the canisters 114 to stack closely beside each other, with little space between them. This wedge-shaped design allows the cylindrical electrodes 116, which are radially disposed around less than half of the OPC drum circumference, to be closely adjacent to each other, that is, preferably 1–2 inches apart at their axes. The larger ends of the canisters 114 extend fan-like up from the OPC drum, so that the developers are substantially above and beside, rather than below, the OPC drum 104, charging station 110, and waste station 108.

The IT belt 106 of FIG. 3 may be lengthened for various paper platforms. Preferably, the intermediate transfer (IT) belt is sized appropriately at the time of manufacture for the predetermined media and platform size requirements for each printer.

From the IT belt 106 the media with the unfixed color toner images on the surface is advanced through a fuser and pressure roll 295, 296 to fuse the color toner image to the media. With pinch rolls 323 the media is then advanced for application of clear toner in the same way as described above for FIG. 1.

Figure 4:
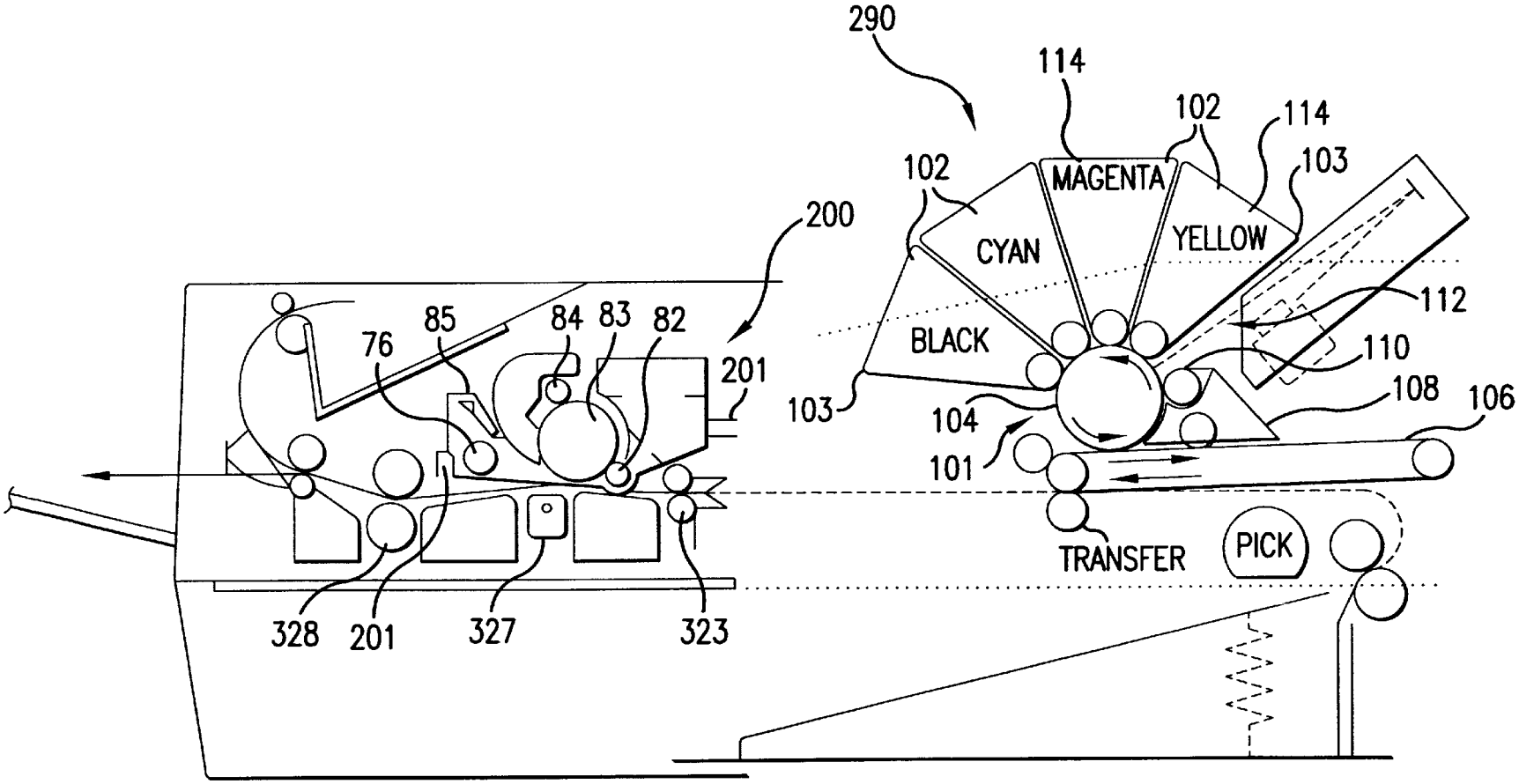
FIG. 4 is a simplified schematic of an alternate electrophotographic color imaging system incorporating disposable clear toner cartridge of the invention.

Reference is now made to FIG. 4. This illustrates a system similar to the system of FIG. 3, except the fuser rolls for the color toner have been deleted and both the color toners applied at developers 102 and the clear toner applied at cartridge 200 are fused at the same time at fuser rolls 328. FIG. 4 also shows structure 201 which is used to removably an nonfixedly hold the cartridge 200 in position.

Figure 4A:
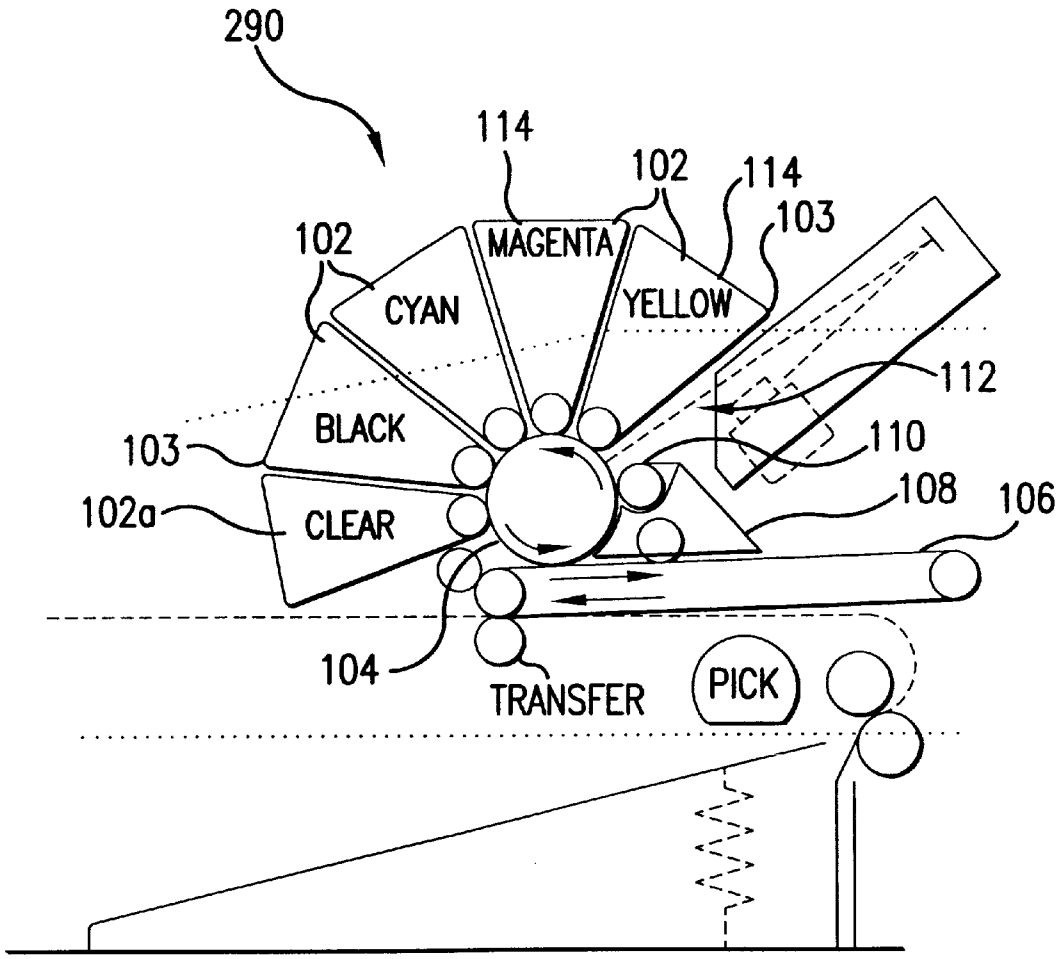
FIG. 4*a* is a simplified schematic of an alternate electrophotographic color imaging system incorporating a disposable clear toner cartridge of the invention incorporated into the color-imaging engine.

Reference is now made to FIG. 4*a,* which shows how an imaging system may be redesigned to incorporate the invention. The systems for color toners, as illustrated in FIGS. 3 and 4 is modified so that the clear toner cartridge is more integrated into the system. In FIG. 4*a,* this system comprises a module with radially disposed, wedge shaped developers, both color 102 and clear 102*a*. The clear toner developer 102*a,* is in the form of a removable cartridge that is structured similar to the wedge-shaped color developers, and is also disposed around the OPC or photoconductive drum 104. The imaging array 111, which is used to form the images on the OPC 104 that are developed by color developers 102, is also available for use for applying the clear toner from the clear toner cartridge 102*a*. The clear toner can be applied in a pattern, or used to spot certain media surface areas, printed or nonprinted, for selected treatment for surface finish. A separate imaging array just for the clear toner may also be added for imaging the clear toner, particularly in the systems as illustrated in FIGS. 1*a,* 3, 4, 5 and 6, where there is a photoconductive drum separate from the color imaging system.

Figure 5:
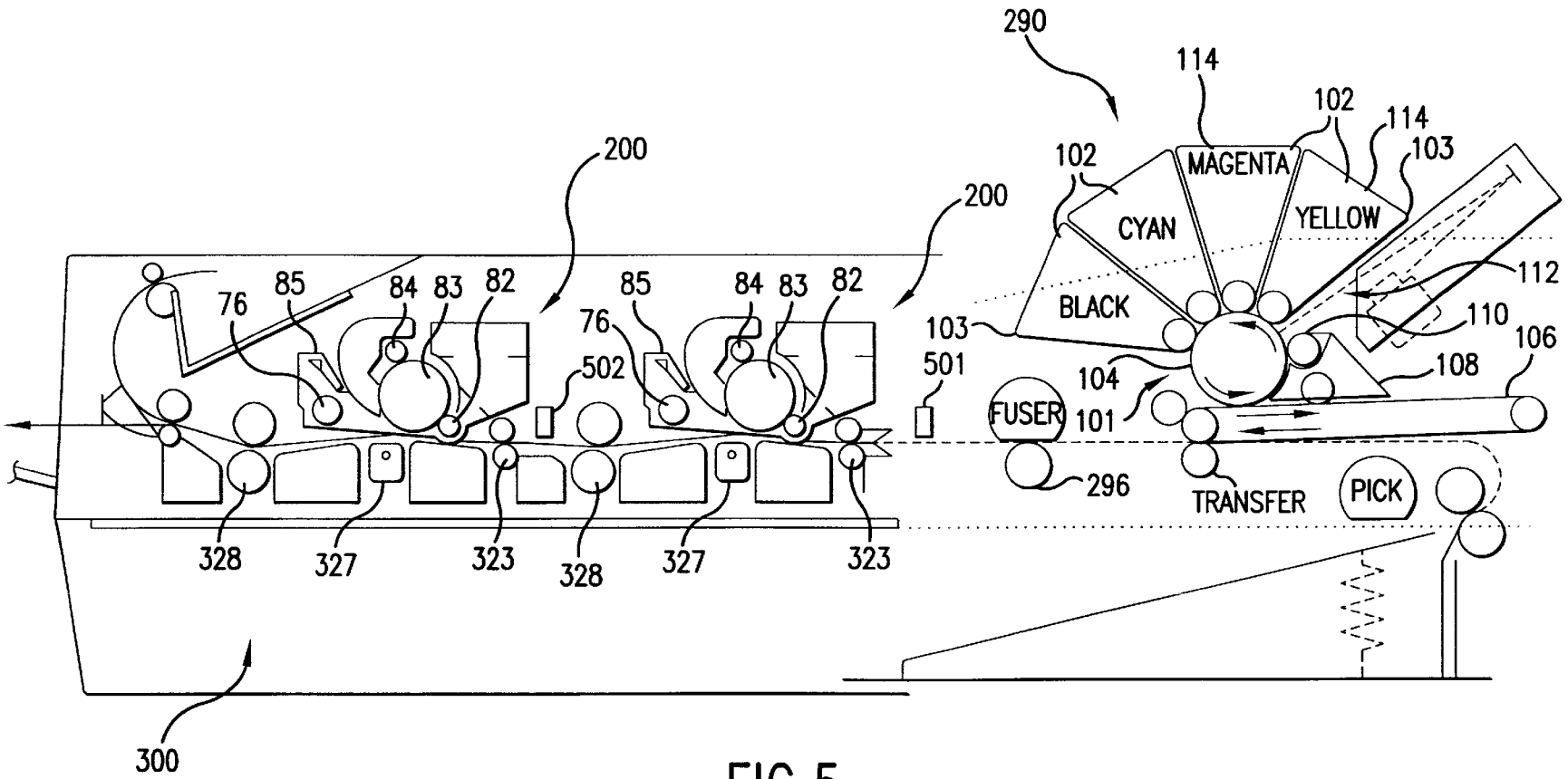
FIG. 5 is a simplified schematic of an alternate electrophotographic color imaging system incorporating two disposable clear toner cartridges of the invention.

Reference is now made to FIG. 5. FIG. 5 illustrates a system similar to that of FIG. 3, except instead of one clear toner cartridge, two clear toner cartridges are supplied. The media from the color imaging system 290, which may be fused or unfused, passes through the clear toner developing system as in FIG. 3 and then passed immediately into a like system. There may be fusing rollers 328A between the clear toner cartridges 200, as shown, or both clear toner applications may be fused by a final fusing rollers 328.

Figure 6:
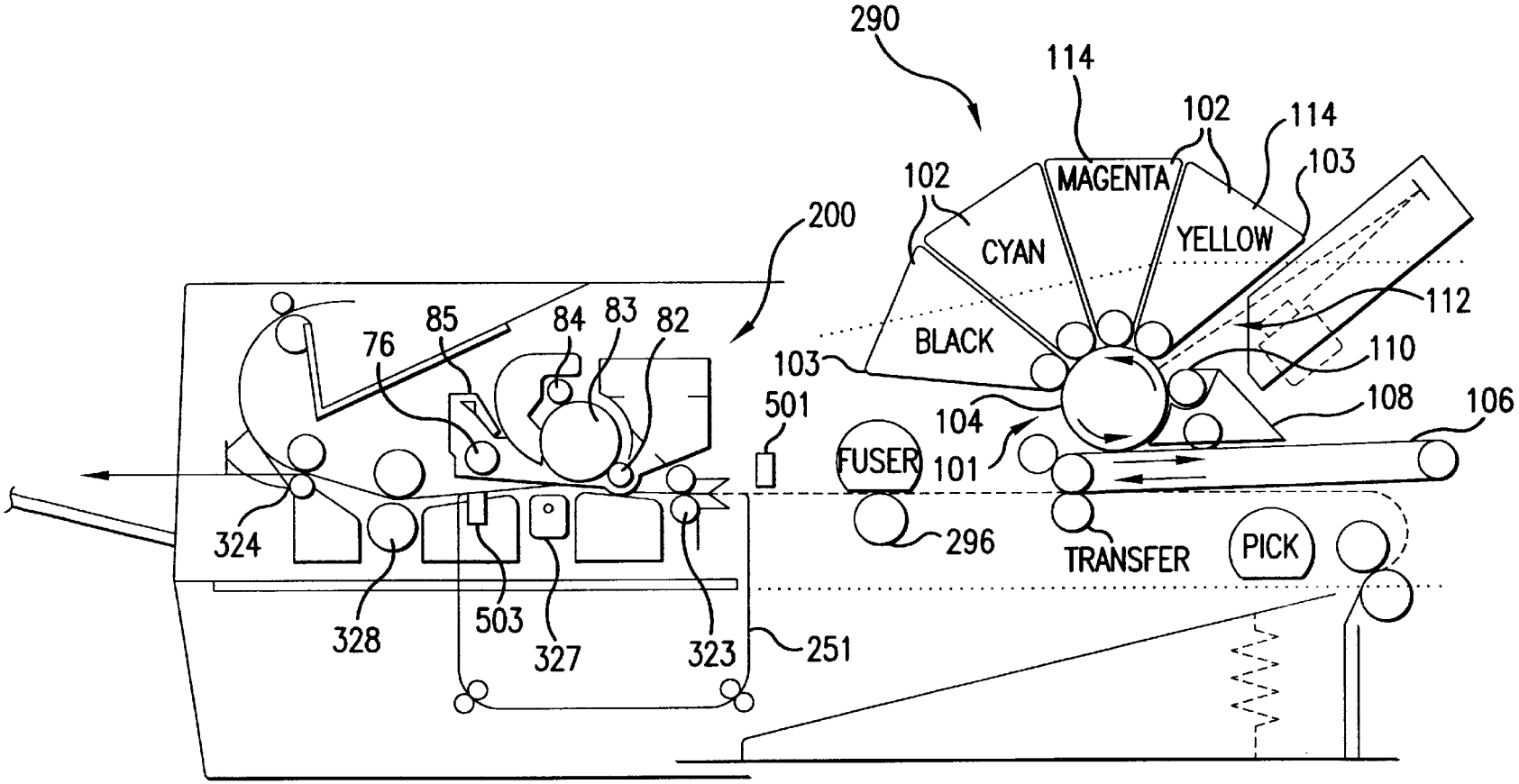
FIG. 6 is a simplified schematic of an alternate electrophotographic color imaging system incorporating disposable clear toner cartridge of the invention with a system for recycling or shuttling the media to pass the media multiple times by the clear toner developer.

Reference is now made to FIG. 6. This illustrates a system similar to the system of FIG. 3, except that there is a recycle or shuttle mechanism for applying a second layer clear toner from a single clear toner cartridge 200. The shuttle or recycle may be by any suitable means. A shuttle-type drive is disclosed in U.S. Pat. No. 5,978,642. The media is first coated with a clear toner, as previously described, and advance to shuttle path 250, after which it is reversed and passed in the opposite direction by the clear toner cartridge and then advance again by the clear toner cartridge 200 for a second application of clear toner. Alternately, instead of being advanced into a shuttle path, the media may be advanced after emerging past the clear toner cartridge around a recycle path 251 to a point before the clear toner cartridge and passed again past the clear toner cartridge for an additional coating of clear toner. An advantage of these systems, is that the media can be coated with clear toner any number of times and the number applications is not limited by the single toner cartridge. The media may be passed through fusion rollers before a reapplication or all the layers may be fused by a single fusion.

Figure 7:
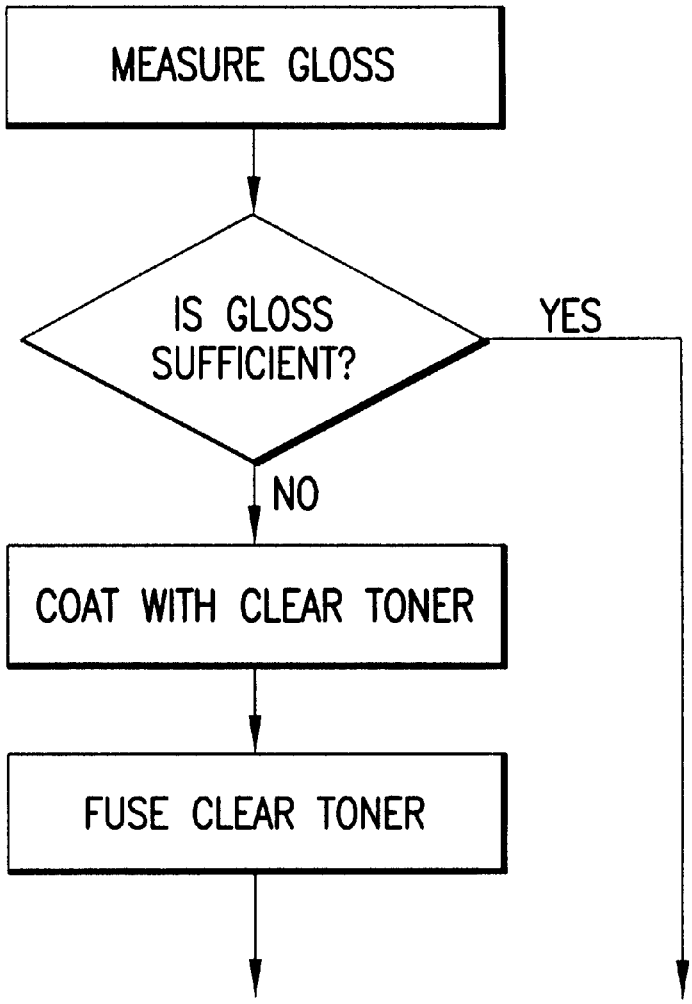
FIG. 7 is a flow sheet illustrating a control system used in conjunction with the clear toner cartridge of the invention.

Reference is now made to FIG. 7, which is a flow-sheet for a system for controlling gloss having at least one clear toner cartridge. The gloss is measured (501 in FIG. 3) by any suitable system. If the gloss is less than a predetermined standard clear toner is applied to the media as it passes the clear toner cartridge, and the clear toner is fused. If the gloss level is sufficient, the media is passed by the clear toner cartridge with no toner being applied.

Figure 8:
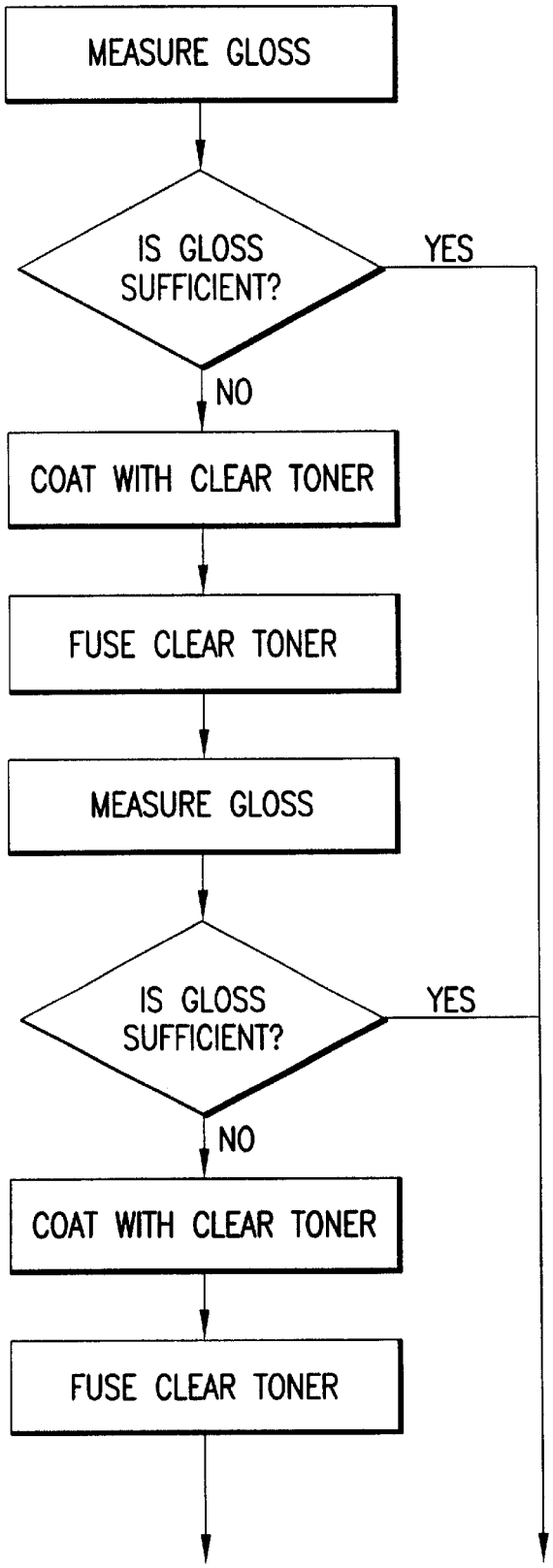
FIG. 8 is a flow sheet illustrating another control system used in conjunction with the clear toner cartridge of the invention.
Figure 9:
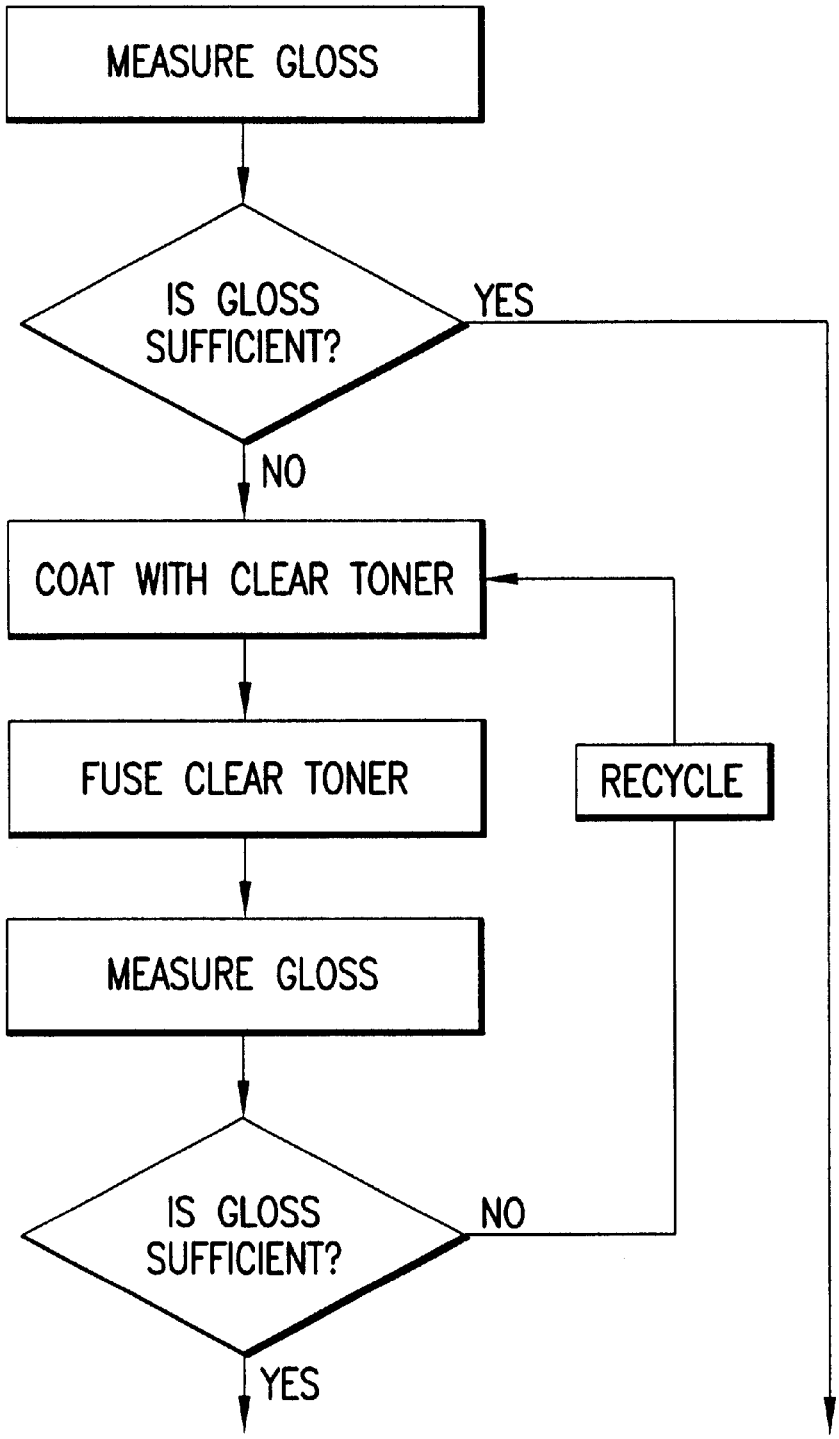
FIG. 9 is a flow sheet illustrating another control system used in conjunction with the clear toner cartridge of the invention.

Reference is now made to FIG. 8, which is a flow sheet of control scheme for a gloss control system having at least two clear toner cartridges. The scheme proceeds initially as in FIG. 7. After the initial application of clear toner is fused, the gloss level is remeasured, and the scheme proceeds again in a similar manner, making a second application of toner if the gloss is still insufficient, and fusing the clear toner. The first and second measurements of the gloss level can be conducted by appropriately disposed gloss meters (501, 502, respectively in FIG. 5), Reference is now made to FIG. 9, which is a flow sheet of control scheme for a gloss control system having at least one clear toner cartridge associated with the shuttle or recycle mechanism. The system proceeds initially as in FIG. 7. After the first fusing of the clear toner, the gloss is remeasured, and if the gloss is insufficient the media to advanced through the shuttle or recycle mechanism to the beginning the clear toner application, and a second application of clear toner is made. This process is repeated until the gloss condition is met. To prevent an infinite loop in the event of equipment failure the scheme can include a maximum limit to the number of clear toner applications. First and subsequent gloss measurements can be made by appropriately disposed gloss meters (501, 503 respectively in FIG. 6).

Figure 10:
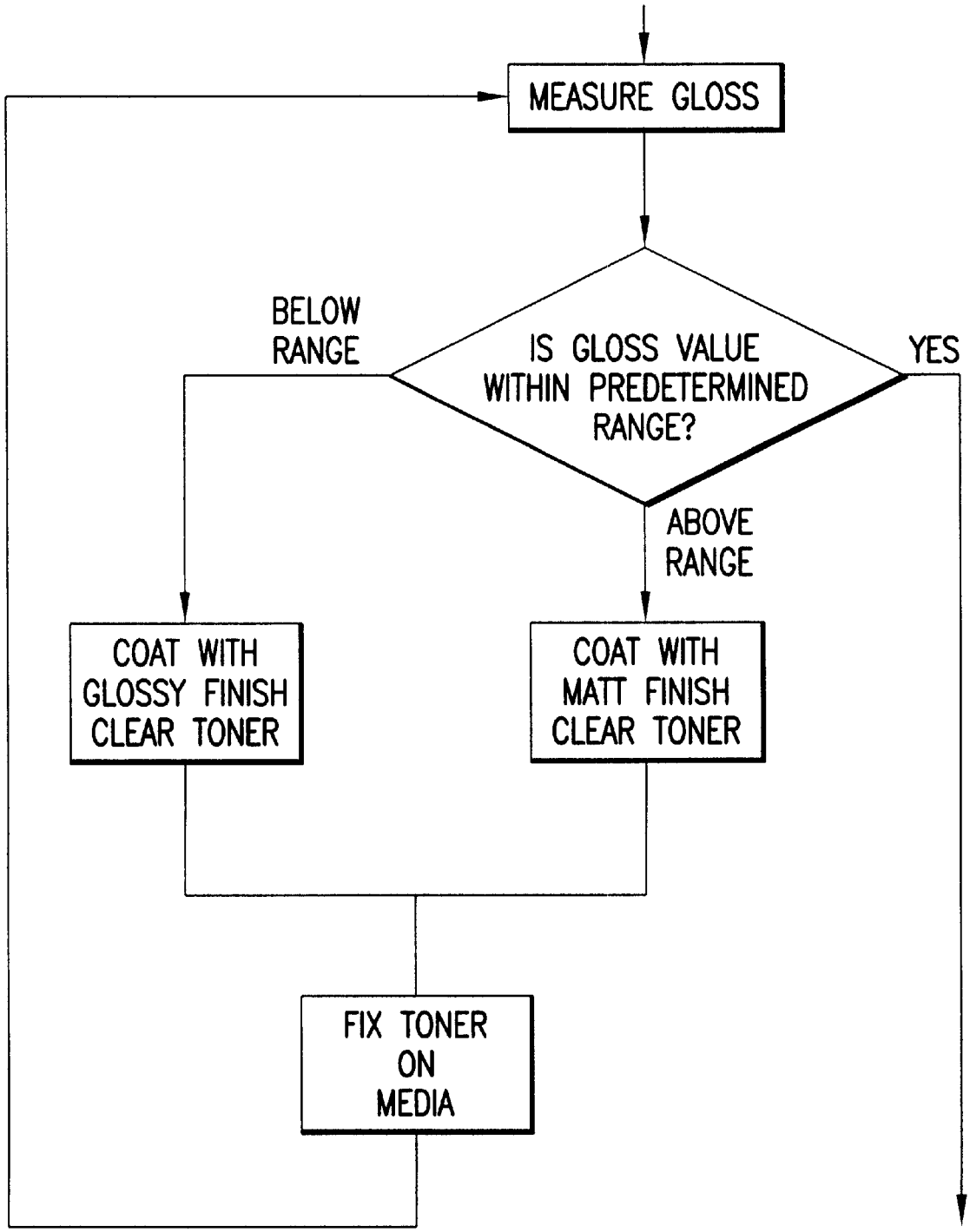
FIG. 10 is a flow sheet illustrating another control system used in conjunction with the clear toner cartridge of the invention.

Reference is now made to FIG. 10, which is a flow sheet of a control scheme used with a gloss control system having at least two clear toner cartridges, as in FIG. 5. There are different clear toner compositions in each cartridge, one composition being one that imparts a matt finish, and the second being one that imparts a gloss finish. In this system, the gloss is measured, and compared with the predetermined standard. If the standard is met, the media is not treated, but if the printed media is either too glossy or too matt, it is coated with a clear toner. If it is too matt, the toner from the cartridge containing clear toner that imparts a glossy finish is applied and fixed to the media. If it is too glossy, the toner from the cartridge containing clear toner that imparts a matt finish is applied and fixed to the media. The media can then optionally be further processed by measuring the gloss and repeating the above process as many times as required to meet the gloss standard, or the media left with just one treatment. The control system may also regulate the amount of toner applied to the media, a large amount when a large gloss adjustment is required, or a small amount if a small gloss adjustment is required.

While this invention has been described with reference to certain specific embodiments and examples, it will be recognized by those skilled in the art that many variations are possible without departing from the scope and spirit of this invention, and that the invention, as described by the claims, is intended to cover all changes and modifications of the invention which do not depart from the spirit of the invention.

What is claimed is:

1. An imaging apparatus for producing a predetermined gloss on a printed media comprising;

at least one color toner station for applying a color toner image to a media surface, at least one clear toner station comprising a disposable clear toner cartridge removably and nonfixedly attached to the imaging apparatus, the cartridge comprising; a cartridge housing, clear toner hopper disposed in the housing, clear toner in the hopper, toner outlet communicating with the hopper, structure for controllably transferring clear toner from the outlet of the toner cartridge to the media surface and over the color toner image on the media surface, at least one fixer for fixing the color toner image and the clear toner to the media, the clear toner having gloss properties that impart upon fusing to the media a surface with a predetermined gloss, at least one gloss detector for measuring the surface gloss of the media before the clear toner is transferred to the media, controller for selectively activating the clear toner cartridge to apply clear toner to the media surface in response to output from the at least one gloss detector, and structure for directing the media for at least two measurements by the at least one gloss detector for at least two selective activations by the controller in response to the output of the at least one gloss detector.

2. An imaging apparatus for producing a predetermined gloss on a printed media comprising;

at least one color toner station for applying a color toner image to a media surface, at least one clear toner station comprising at least two clear disposable toner cartridges containing the same or different clear toners, each clear toner cartridge removably and nonfixedly attached to the imaging apparatus, each cartridge comprising; a cartridge housing, clear toner hopper disposed in the housing, clear toner in the hopper, toner outlet communicating with the hopper, structure for controllably transferring clear toner from the outlet of the toner cartridge to the media surface and over the color toner image on the media surface, at least one fixer for fixing the color toner image and the clear toner to the media, the clear toner having gloss properties that impart upon fusing to the media a surface with a predetermined gloss, at least one gloss detector for measuring the surface gloss of the media before the clear toner is transferred to the media, and controller for selectively activating the clear toner cartridge to apply clear toner to the media surface in response to output from the at least one gloss detector, and wherein the controller separately activates each cartridge in response to output from the at least one gloss detector.

3. An imaging apparatus as in claim 2 wherein the imaging apparatus comprises at least two gloss detectors with one detector for each clear toner cartridge.

4. An imaging apparatus for producing a predetermined gloss on a printed media comprising;

at least one color toner station for applying a color toner image to a media surface, at least one clear toner station comprising a disposable clear toner cartridge removably and nonfixedly attached to the imaging apparatus, the cartridge comprising; a cartridge housing, clear toner hopper disposed in the housing, clear toner in the hopper, toner outlet communicating with the hopper, structure for controllably transferring clear toner from the outlet of the toner cartridge to the media surface and over the color toner image on the media surface, at least one color fixer for fixing the color toner image to the media and at least one clear toner fixer separate from the color toner fixer for fixing the clear toner to the media, and the clear toner having gloss properties that impart upon fusing to the media a surface with a predetermined gloss.

5. A method for applying an image to a media surface comprising;

forming a color toner image upon a media surface in an imaging apparatus, manually attaching a disposable clear toner cartridge to the imaging apparatus, the cartridge removably and nonfixedly attached to the imaging apparatus, the cartridge comprising; a cartridge housing, clear toner hopper disposed in the housing, clear toner in the hopper, toner outlet communicating with the hopper, wherein the attaching of a the cartridge disposes the disposable cartridge such that clear toner from the toner outlet can be applied to the media surface, monitoring the media surface by qualitatively measuring a gloss property of the surface and determining if the measure of the gloss property meets a preset condition, selectively applying clear toner from the outlet over the media surface and over the color toner image in response upon condition of the measure meeting the preset condition, and fixing the color toner image and the clear toner on the media by separately fixing the color toner image and clear toner.

6. A method as in claim 5 wherein the color toner image is fixed before the applying of the clear toner.

7. A method for applying an image to a media surface comprising;

forming a color toner image upon a media surface in an imaging apparatus, manually attaching a disposable clear toner cartridge to the imaging apparatus, the cartridge removably and nonfixedly attached to the imaging apparatus, the cartridge comprising; a cartridge housing, clear toner hopper disposed in the housing, clear toner in the hopper, toner outlet communicating with the hopper, wherein the attaching of a the cartridge disposes the disposable cartridge such that clear toner from the toner outlet can be applied to the media surface, monitoring the media surface by qualitatively measuring a gloss property of the surface and determining if the measure of the gloss property meets a preset condition, selectively applying clear toner from the outlet over the media surface and over the color toner image in response upon condition of the measure meeting the preset condition, fixing the color toner image and the clear toner on the media, and wherein the applying the clear toner is conducted a plurality of times, each time preceded by measuring a gloss property and each time conducted in response upon condition of the measure meeting the preset condition.

8. A method as in claim 7 wherein the preset condition for the initial applying is different than the present condition for any of the subsequent applyings.

9. A method as in claim 7 wherein the preset condition for the initial applying is the same as the present condition for any of the subsequent applyings.

10. A method as in claim 7 wherein the fixing of the clear toner is conducted after each applying of the clear toner.

11. A method as in claim 7 additionally comprising unattaching the disposable clear toner cartridge when the clear toner hopper is empty of clear toner.

12. A method for controllably applying clear toner to media with a color toner image on the surface of the media based upon a gloss property of the media, comprising the steps of;

(1) measuring the property for a qualitative measure of the property, (2) comparing the qualitative measure of the property with a preset condition and conducting step (3) if the qualitative measure does not meet the preset condition, (3) coating the media with a clear toner, (4) fixing the clear toner to the media, (5) repeating step (1) and stopping at step (2) when the qualitative measure meets the preset condition, and wherein repetition of the coating in step (3) is accomplished at a coating station different from the coating station for the initial coating of step (3).

13. A method for controllably applying clear toner to media with a color toner image on the surface of the media based upon a gloss property of the media, comprising the steps of;

(1) measuring the property for a qualitative measure of the property, (2) comparing the qualitative measure of the property with a preset condition and conducting step (3) if the qualitative measure does not meet the preset condition, (3) coating the media with a clear toner, (4) fixing the clear toner to the media, (5) repeating step (1) and stopping at step (2) when the qualitative measure meets the preset condition, and wherein repetition of the coating in step (3) is accomplished by redirecting the media again through the same coating station as the coating station for the initial coating of step (3).

14. A method for controllably applying clear toner to media with a color toner image on the surface of the media based upon a gloss property of the media, comprising the steps of;

(1) measuring the gloss property for a qualitative measure of the gloss property, (2) comparing the qualitative measure of the gloss property with a first preset condition and conducting step (3) if the qualitative measure meets the first preset condition, comparing the qualitative measure of the property with a second preset condition and conducting step (6) if the qualitative measure meets the second preset condition, and stopping coating if both the first and second preset conditions are not met, (3) coating the media with a first clear toner, (4) fixing the first clear toner to the media, (5) repeating step (1), (6) coating the media with a second clear toner, (7) fixing the second clear toner to the media, and (8) repeating step (1).

15. A method as in claim 14 wherein the first preset condition is reflectance higher than a preset standard, the second preset condition is reflectance lower than the preset standard, the first toner comprising a matting agent, to reduce reflectance, and the second toner comprising a gloss agent to increase reflectance.

* * * * *